US006125840A

United States Patent [19]

Soman

[11] Patent Number: 6,125,840

[45] Date of Patent: Oct. 3, 2000

[54] HEATING APPLIANCE FOR APARTMENTS

[76] Inventor: Fazli Soman, Ivedik Cad. 49. Sok. No. 2311, Özevler, Y. MAH., Ankara, Turkey

[21] Appl. No.: 09/331,339

[22] PCT Filed: Dec. 24, 1996

[86] PCT No.: PCT/TR96/00007

§ 371 Date: Jun. 16, 1999

§ 102(e) Date: Jun. 16, 1999

[87] PCT Pub. No.: WO98/28576

PCT Pub. Date: Jul. 2, 1998

[51] Int. Cl.[7] ..... F23M 5/00; F24B 13/02

[52] U.S. Cl. ..... 126/144; 126/101; 126/146; 126/151

[58] Field of Search ..... 126/101, 144–151, 126/58, 64, 60, 8, 369, 77

[56] References Cited

U.S. PATENT DOCUMENTS

| | | | |
|---|---|---|---|
| 2,417,138 | 3/1947 | Stenzy | 126/101 |
| 2,442,124 | 5/1948 | Gilmore | 126/146 |
| 4,406,276 | 9/1983 | Haas | 126/146 |
| 4,416,250 | 11/1983 | Kuzia | 126/146 |
| 4,433,523 | 2/1984 | Miedancer et al. | 126/144 |
| 4,516,563 | 5/1985 | De Larm | 126/101 |

FOREIGN PATENT DOCUMENTS

| | | |
|---|---|---|
| 641974AL | 8/1995 | European Pat. Off. . |
| 51135 | 10/1890 | Germany . |

*Primary Examiner*—James C. Yeung
*Attorney, Agent, or Firm*—Amster, Rothstein & Ebenstein

[57] ABSTRACT

The invention relates to a heating appliance comprising an outer case made entirely of chrome, with various brick systems arranged inside the case. Within the brick systems is arranged a required quantity of chrome pipes, which ensure that the flames are able to spread throughout the appliance and that the bricks and the pipes are heated within a short span of time. To complete and operate the appliance, valves have to be installed at the chimney and outlet of the outer case, so that once the desired temperature has been reached, the valve can be shut and thus the heat maintained for a long time.

4 Claims, 9 Drawing Sheets

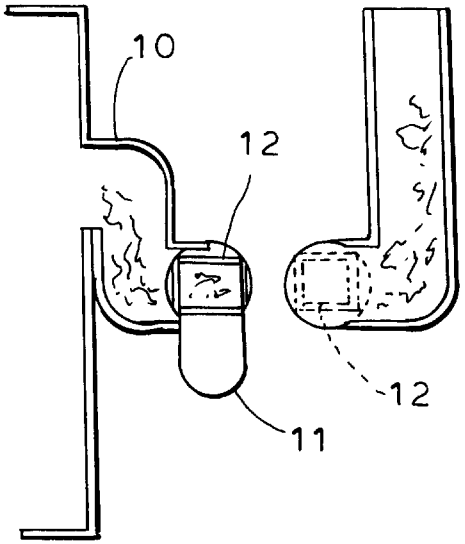
FIG. 7
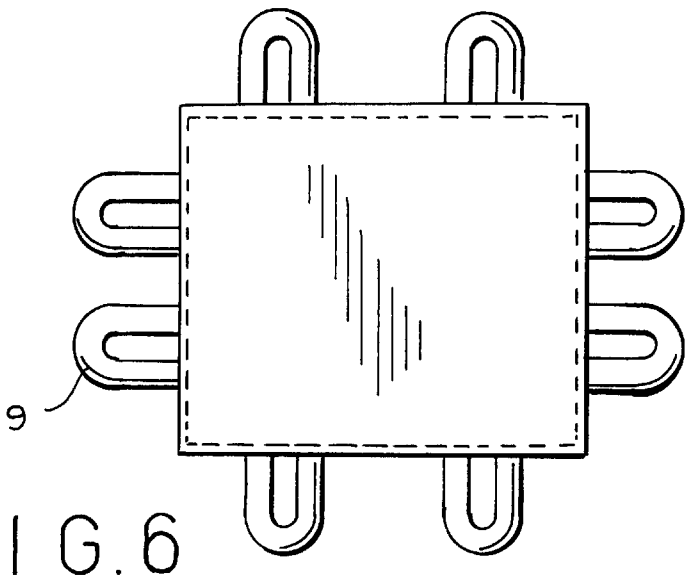
FIG. 6
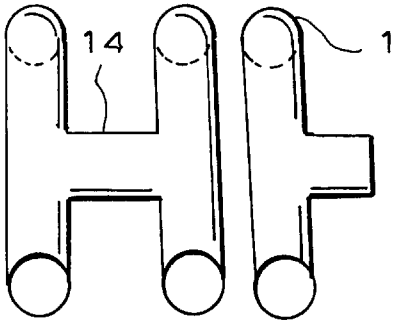
FIG. 8
FIG. 9

HEATING APPLIANCE FOR APARTMENTS

This application is a national phase application corresponding to PCT/TR96/00007 filed Dec. 24, 1996.

FIELD OF THE INVENTION

The invention relates to a heating appliance comprising an outer case made entirely of chrome, with various brick systems arranged inside the case, and within the said brick systems a required quantity of chrome pipes and valves is arranged. The arrangement of the brick system together with pipes and valves ensure that the flames are able to spread throughout the appliance and further enabling that the bricks and the pipes are heated within a short span of time, and once the desired level of temperature is attained the heat inside the appliance is maintained for a long time.

BACKGROUND AND OBJECT OF THE INVENTION

The conventional domestic heating appliances using hard and liquid fuel are at least 120% hazardous for the environment and the economy. The loss of heat in conventional heating appliances is rather high since in most cases the appliance has to keep burning and operating in order to maintain desired level of temperature. This inefficient means of burning of the fuel results in using more fuel to attain and maintain the desired level of temperature, which in turn results in more expense for the user leading to more economic outlays. Inefficiency of the traditional fuel burning systems of burning the fuel further leads to disposing more of undesirable fumes and smog causing damage to the environment.

The object of this invention is to supply a more efficient system for burning the fuel which is more economical and less hazardous to the economy. A new heating appliance to be used domestically in apartments to replace the conventional heating appliances has been designed to overcome these problems. The appliance constructed according to this invention utilizes a battery type system suitable to be used domestically in any closed indoor environment. The appliance according to this new system, in comparison to the conventional systems, has only a 20% hazardous effect on the environment and the economy. The technical features of the appliance is described below with references to the accompanying drawings.

BRIEF DESCRIPTION OF THE DRAWINGS

FIG. 6 is a plain view of the top of the heating appliance illustrating and of the mounting means for mounting the hood over the top of the frame of the appliance.

FIG. 7 is a cross sectional view of the smoke outlet pipe illustrating the valve installed on the said pipe for regulating the flow.

FIG. 8 and FIG. 9 is the illustration of the cross sectional partial views of the dry steam pipes as viewed from the top.

FIG. 13 illustrates the views from the top (Ü), from the bottom (A), from the side (Y) and front end (B) of the bricks which do not have wholes for smoke outlet pipes to pass through.

FIG. 14 illustrates the top view and front end view of the bricks which are installed under the side panels of the outer frame of the appliance.

DESCRIPTION OF THE PREFERRED EMBODIMENTS

Figure 2:
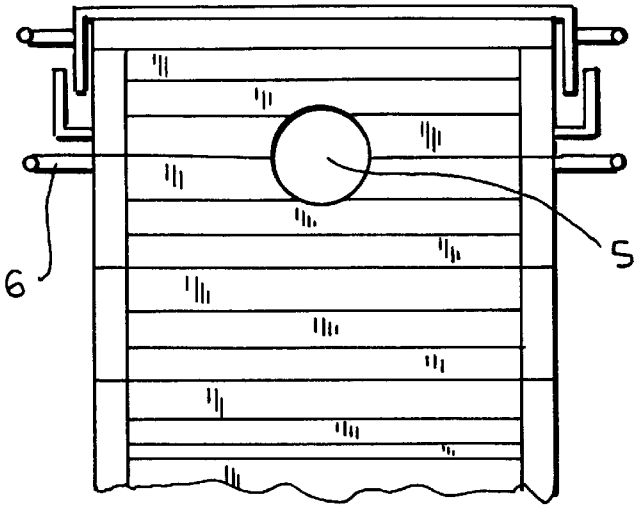
FIG. 2 is a cross sectional view of the top portion of the heating appliance as viewed from the rear of the appliance.
Figure 1:
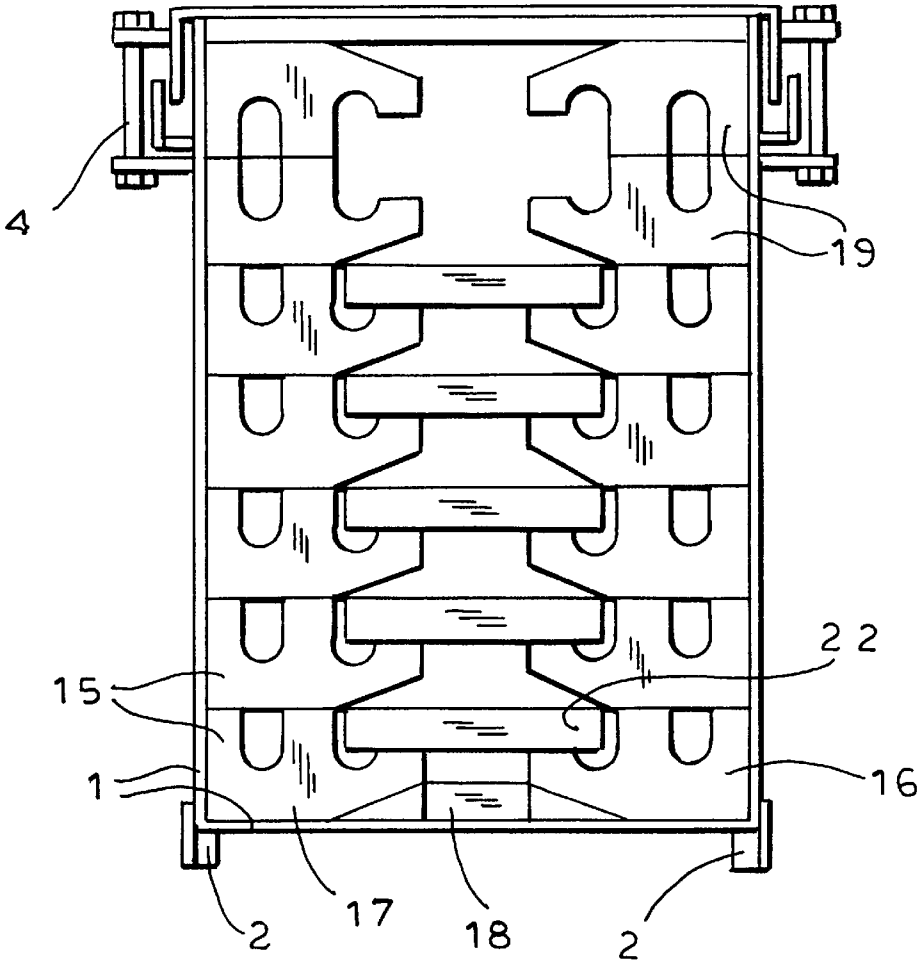
FIG. 1 is a cross sectional view of the heating appliance in its complete form as viewed from the left/right side of the appliance.
Figure 3:
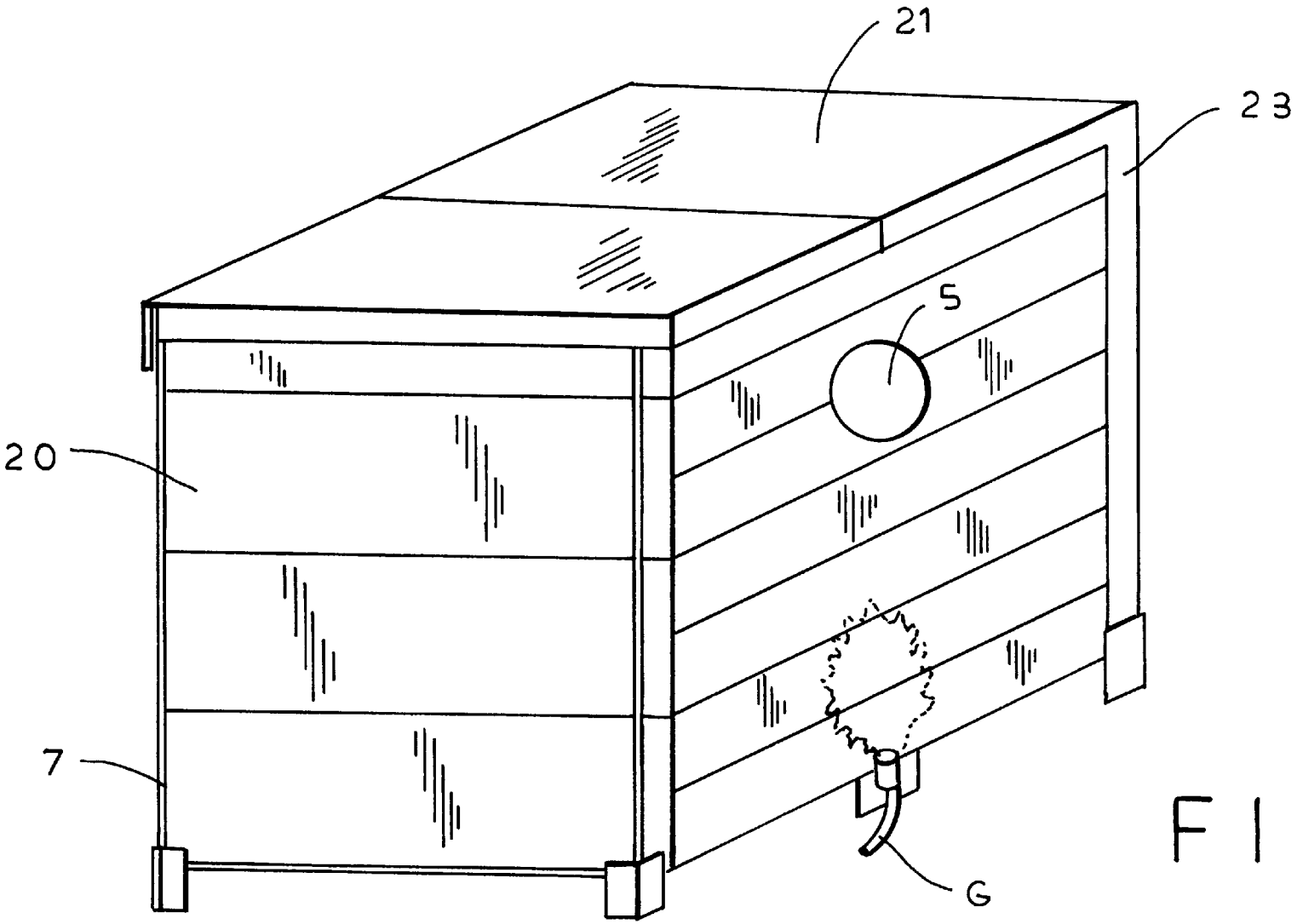
FIG. 3 is a three dimensional view of the heating appliance in its complete final form illustrating the top, one side and the rear views of the outer surfaces of the appliance.

A new heating appliance to be used domestically in apartments to replace the conventional heating appliances has been described below in detail with respect to its operational techniques through mechanical and cross sectional descriptions.

The basic supplies used for building the appliance, namely, the chrome steel and bricks, have been explained with their technical descriptions and cross sectional drawings. All types of flammable gases, except those gases which are hazardous to the environment or those which emit radioactive smog, can be utilized in the appliance as a burning fuel after being mixed with air.

The body of the appliance has been designed to include a frame (1), four legs (2), and a lid or hood at the top (3). The lid is fastened to the body by mounting means (4) for mounting the said lid or hood over the frame top. An L-shaped angle iron is supplied which is fastened with a certain gap to the body frame in such a manner that the sides of the lid contacts the body frame. Asbestos is placed into the U-shaped 5 mm groove on the body frame.

The outer case of the frame is made entirely of chrome steel. Inside the body frame a brick system is arranged to form the inner structure. In forming the brick system as they are stacked no mortar as a binding agent between the bricks is to be used.

Figures 17, 18:
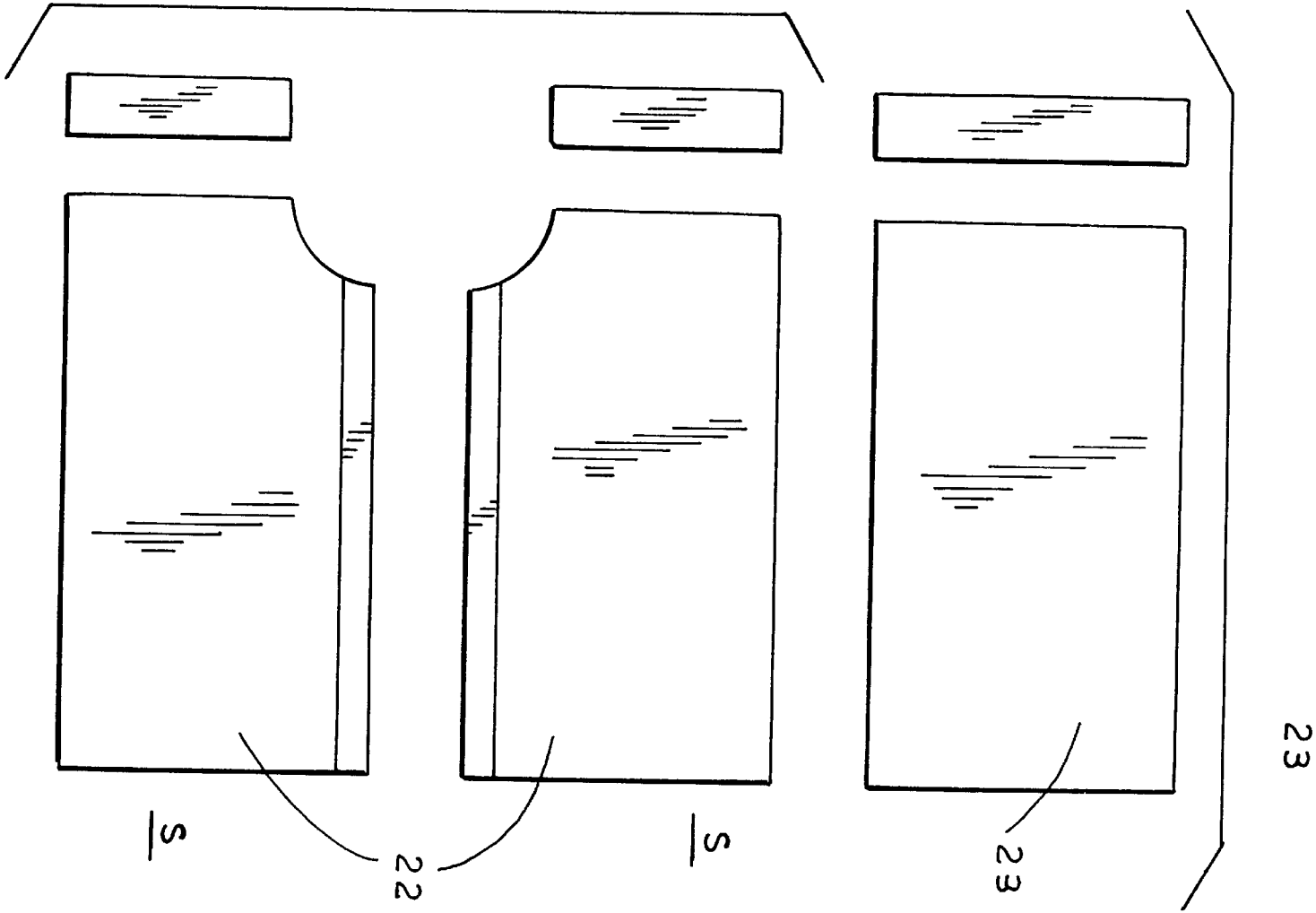
FIG. 17 illustrates the intermediate bricks shown in FIG. 1 under numeral 22, viewed from the top of the brick as well as from the front end of the brick.
FIG. 18 illustrates the top view and front end view of the bricks which are installed on the bottom panel of the outer frame of the appliance.

In order to protect the steel frame (1), inner side of the frame is lined with lining bricks (20, 21, 23). Also supplied are bridge shaped bricks (15, 16, 17) which are arranged as stocks of rows in the frame at both front and at the back which also serve as the housing for the dry steam pipes (13, 14). Between the bridge bricks are supplied rectangular shaped bricks one corner of which is cut off in an oval form (22) as shown in FIG. 17. Also supplied are vent-defining bricks (19) defining an outlet and discharge vent for receiving said smoke outlet pipe means.

In order to protect the steel frame, inner side of the body is lined with lining bricks (20, 21). Lining bricks (20) are supplied for lining the interior surface of the two opposite sides of the frame, and lining bricks (21) for lining the interior surface of the lid or hood. In arranging the brick system in the said frame bridge shaped bricks (15) are arranged as stacks of rows parallel with the lining bricks. Front bridge shaped bricks (16) and rear bridge shaped bricks are disposed on the said frame (1) bottom and the said bricks are.

Between the said bridge bricks are supplied rectangular shaped bricks with an oval cut off (22). The rectangular shaped bricks with an oval cut off (22) are arranged in left to right and side to side (22 S-S) in shifted positioned manner between the bridge brick system (15) at each stack layer. The arrangement of the bricks with an oval cut off (22) facilitates the formation of the brick channels running parallel to each other that are present at all layers which in turn facilitate the flame to disseminate through all the layers by allowing the flame to move upwards by flowing from the front to the rear and to move upwards layer by layer by flowing from the rear to the front as a result of the shifted positioning of the bricks. Consequently, as the heat in the panel reaches very rapidly to the desired degree and as the heat disseminates throughout the appliance, the whole of the brick system, the said formed brick channels, and the dry steam pipes also heat up in the process. This facilitates an efficient usage of the fuel with a result that the heat of the panel stays at approximately 55° level for five hours after the gas is turned off and the outlet valve is closed. This feature, may specially be advantageous when being used between degrees of −13° C., −14° C. at night and degrees of −3° C., −4° C. during the day. The flow of the flame to upper levels as designated by the letter 'C' facilitates an even distribution of the heat throughout the appliance.

Inside the body frame, the brick system is arranged as stacks of rows in said frame at both said frame front and said frame back, to form the inner structure is such way, that the front bridge shaped bricks (16) and rear bridge shaped bricks (17) are disposed on said frame bottom; and intermediate said front bricks and intermediate rear bricks are disposed as stacks of rows at the intermediate levels; and right-to-left or side-to-side bricks (22 S-S) are disposed forming layers between the intermediate said front bricks and intermediate rear bricks.

As another preferred embodiment, steam pipes (13, 14) formed of chrome are mounted between said intermediate layers to ensure that heat the spreads rapidly throughout the appliance. The said dry steam pipes (13, 14) are of 100 percent chrome steel to prevent the rusting due to non-use of the appliance. The dry steam pipe systems contain sufficient quantity of boiled water which has been electrified a number of times and having a sufficient level of chlorium. The dry steam pipes (13, 14) as they extend within the brick system being housed in the U shaped openings of the brick system (15) should be welded in the manner in which the said dry steam pipes run through the parallel brick channels.

A flame inlet (G) is provided at the center of the rear section of the floor of the case which extends towards the panel located inside. It is important that the flame enters the panel through the entry level so that the flame elevates to the steam pipes and at which level it is manageable for any possible side effects.

As the flame raises and smoke is formed an exit passage way for the smoke is provided as the smoke outlet pipe means (5) at the rear section at the upper level of the outer case fore discharging smoke. Vent-defining bricks (19) defining an outlet and discharge vent for receiving said smoke outlet pipe means are provided at the level just below the lid or hood (3).

The dry steam pipes are to be connected to the chimney constructed of brick or concrete via straight or spiral pipes while allowing sufficient space in between as illustrated in FIG. 7 which indicates the valve system and the flow routes in the channels.

As a preferred embodiment the heating appliance comprises at least one valve installed on said smoke outlet pipe means to maintain heat within said case for a long period of time once said brick systems, said bricks and said smoke outlet pipe means are sufficiently heated.

The elbow of the pipe (10), shows the means for closing the valves to avoid the heat loss after the fuel is switched off when the heat in the panel has reached a levels of up to 200–220° C. After these valves have been closed, the internal heat decreases by 30 degrees in one hour, so that after five hours subsequent to the closing of the exit pipe valves, the heat in the panel stays at about the 50° C. to 70° C. range. This in effect means that the heat is 100% preserved as was proved in testing of the models. Additionally it is necessary that the shut off valve should be located at the entry of the chimney constructed of brick or concrete. This valve will enable the heat in the panel to decrease very slowly and therefore preserve the heat in the panel.

Figure 5:
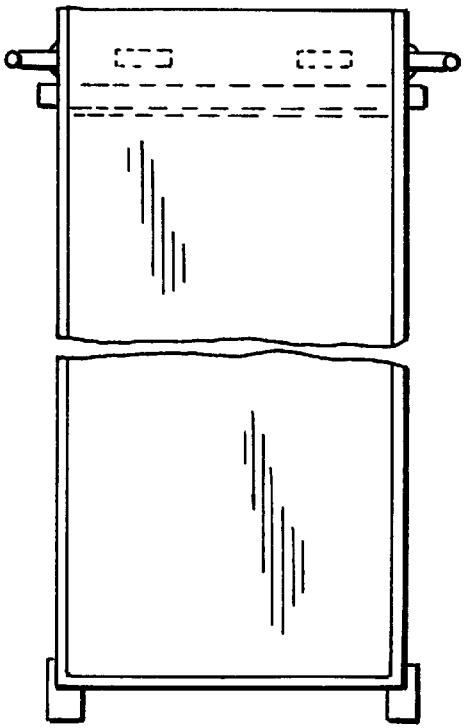
FIG. 5 is the sectional view of FUG. 4 as viewed from the left side of the appliance.
Figure 4:
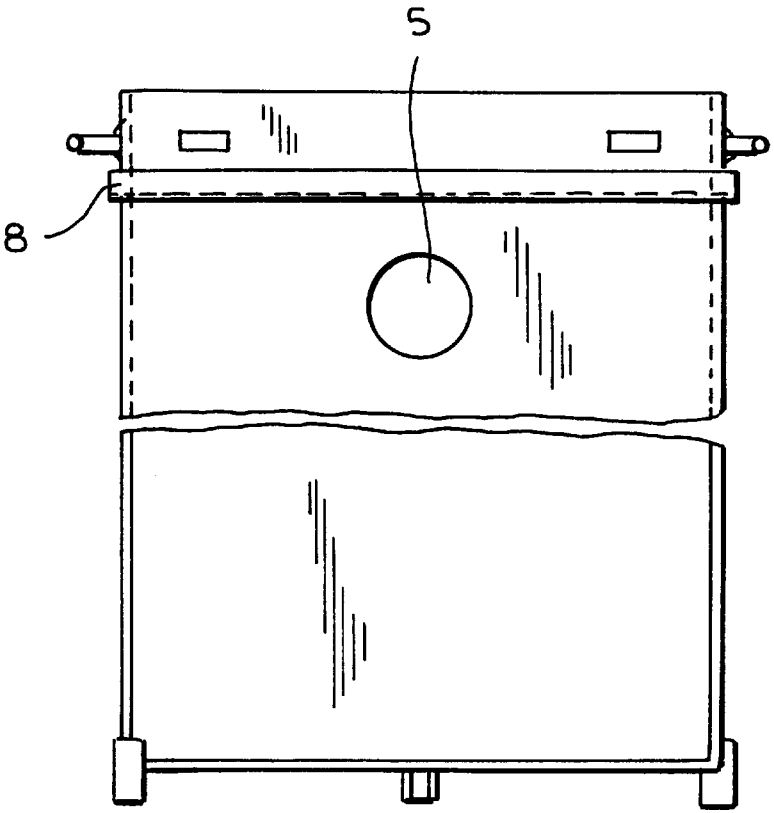
FIG. 4 is a cross sectional view of the heating appliance as viewed from the rear of the appliance illustrating the mounting means for mounting the hood over the top of the frame of the appliance.
Figure 10:
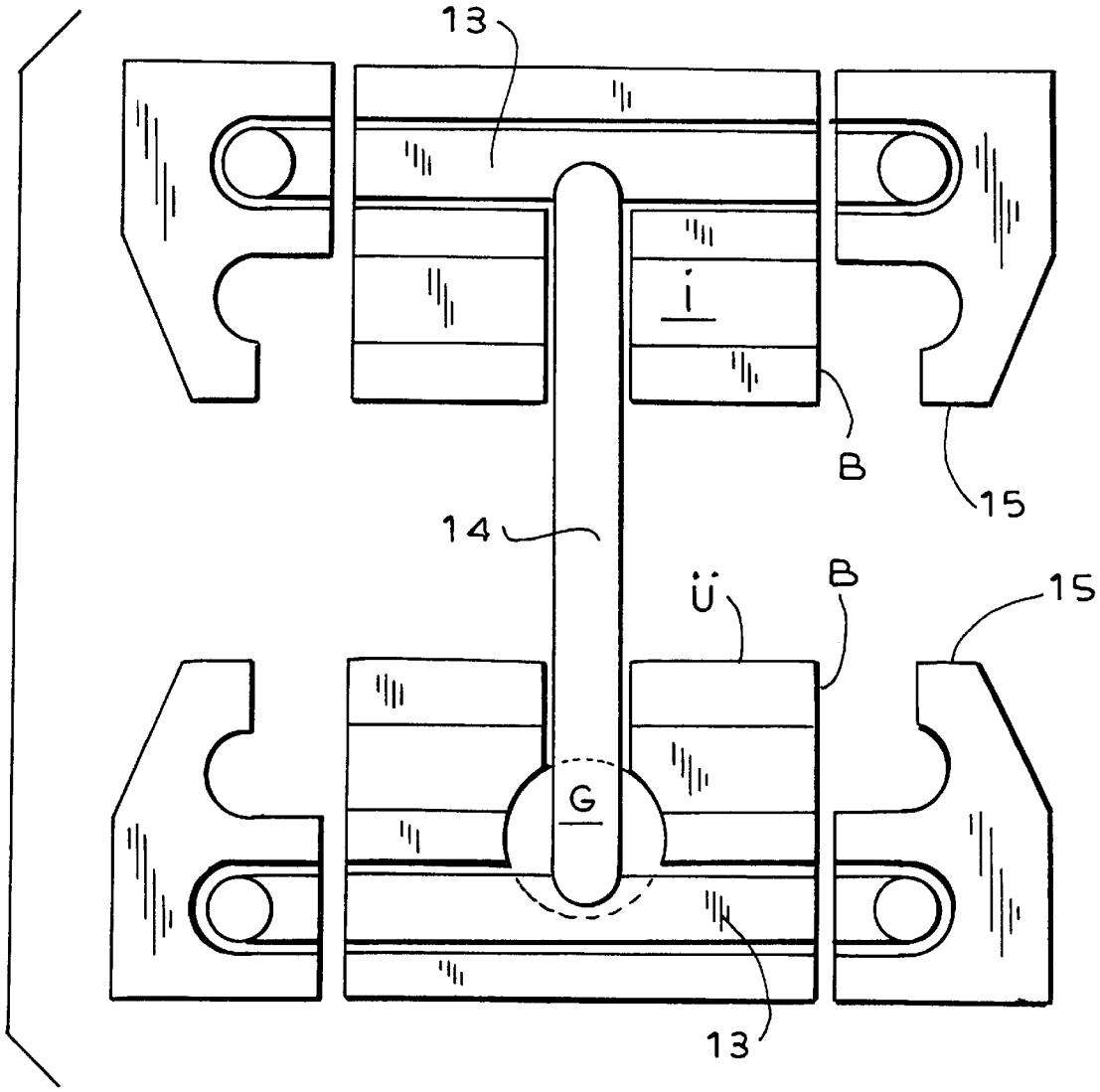
FIG. 10 is a cross sectional view of the heating appliance dissecting the body of the appliance into two halves seen from the above illustrating the cross-sectional views of the tiles and pipes as seen from above.
Figures 11, 12:
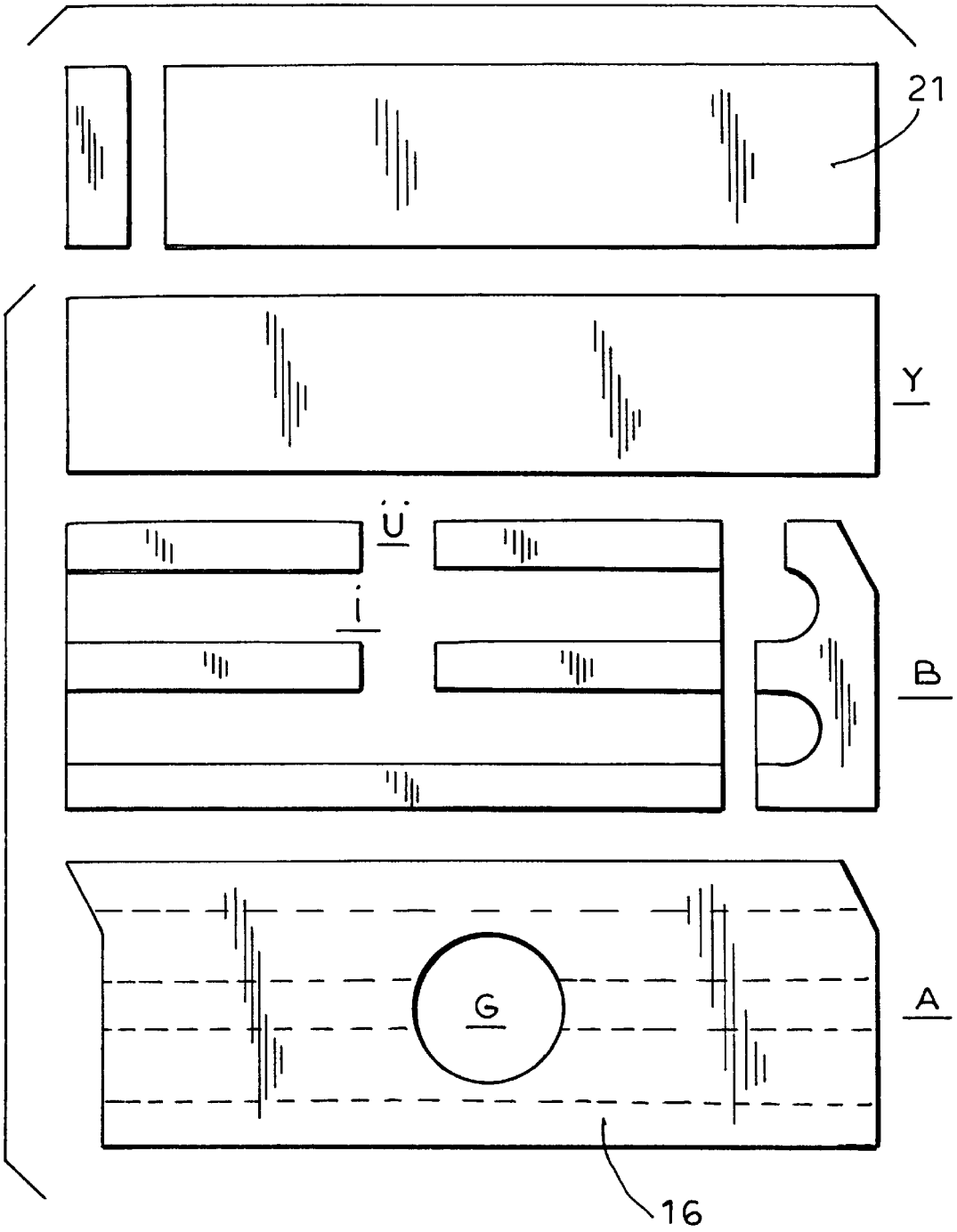
FIG. 11 illustrates the views from the top (Ü), from the bottom (A), from the side (Y) and front end (B) of the bricks in which smoke outlet pipes pass through within.
FIG. 12 illustrates the top view and front end view of the bricks which are installed under the hood at the top of the appliance.
Figures 13, 14:
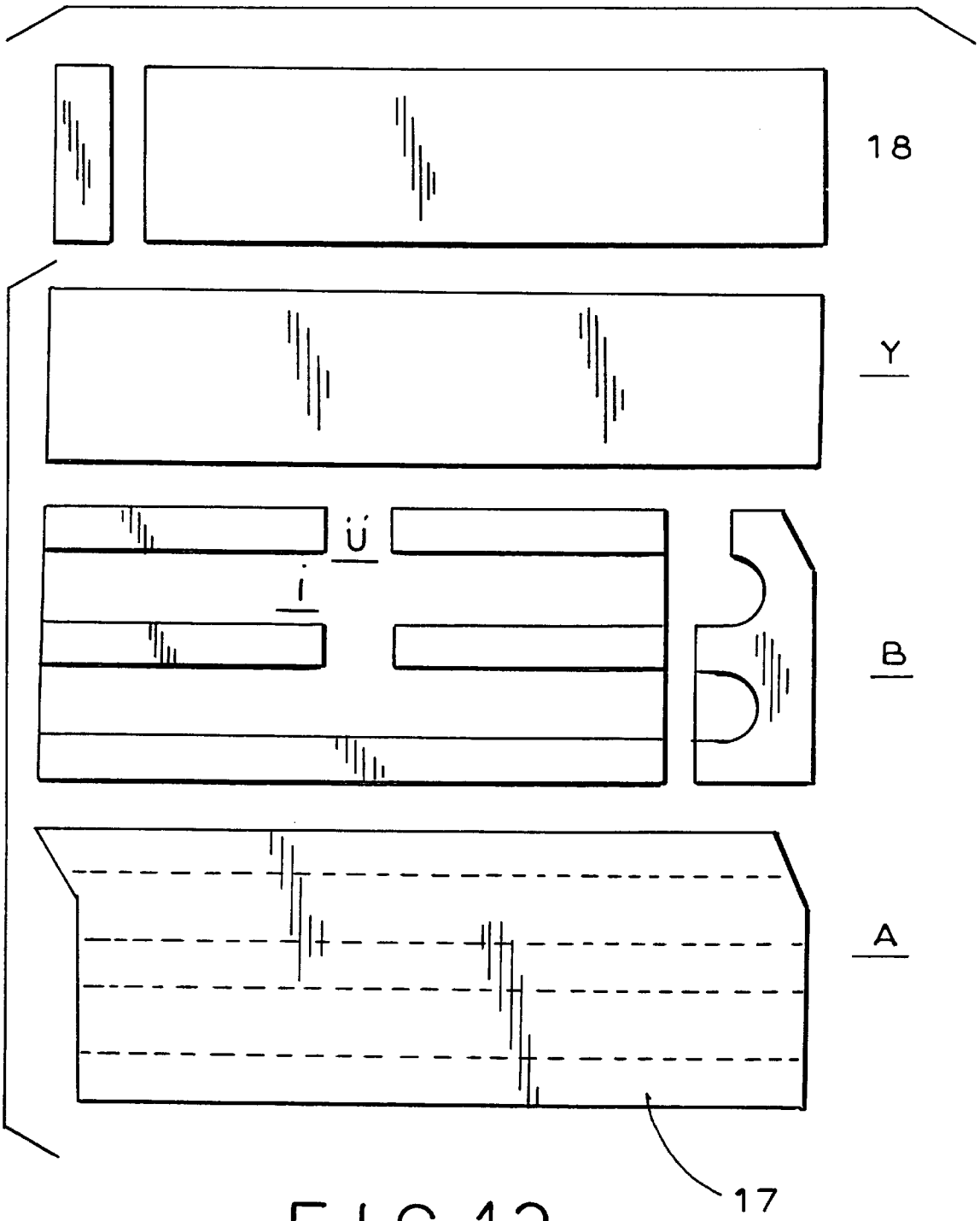
Figures 15, 16:
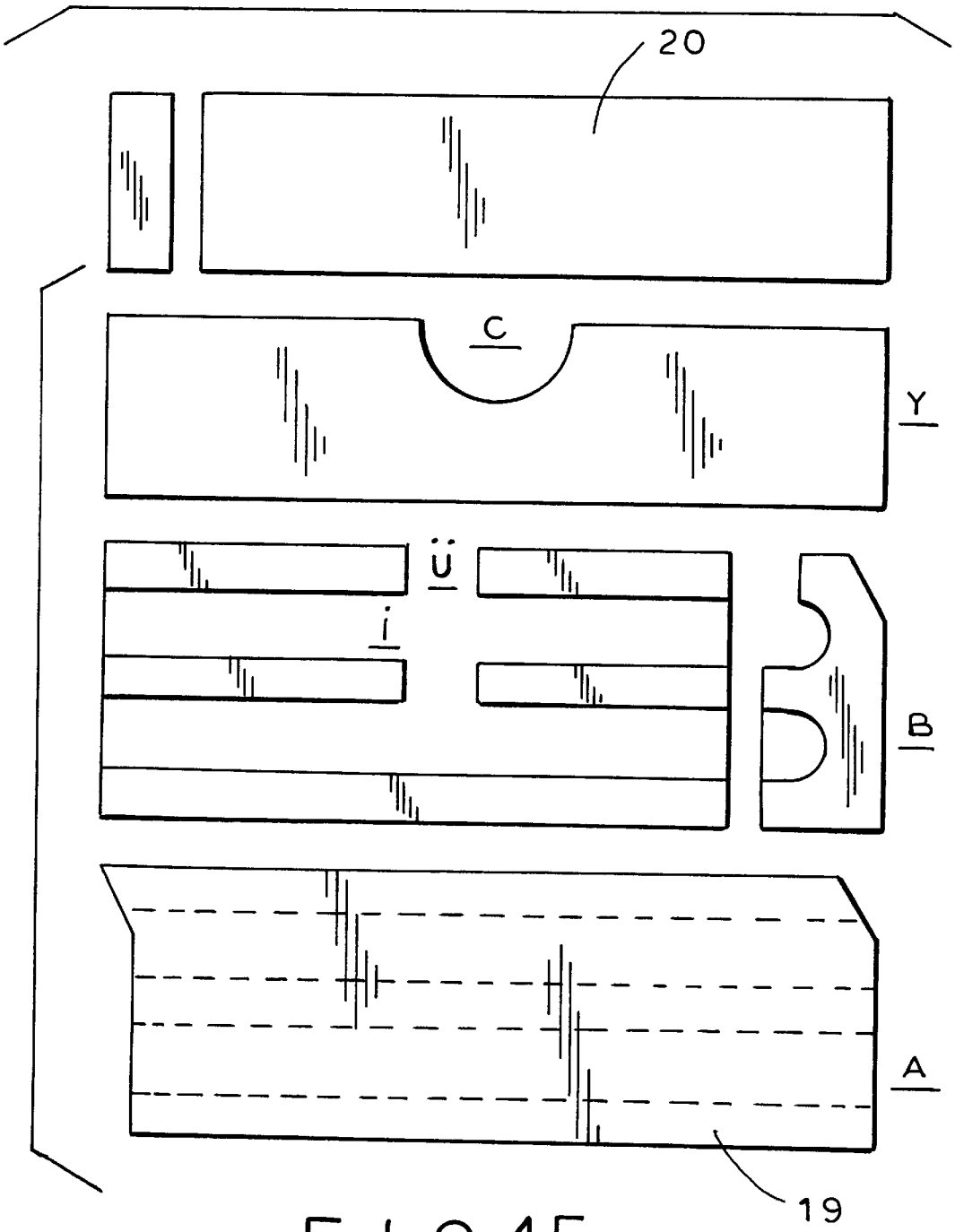
FIG. 15 illustrates the views from the top (Ü), from the bottom (A), from the side (Y) and front end (B) of the bricks which form the chimney outlet section of the heating appliance.
FIG. 16 illustrates the top view and front end view of the bricks which are installed under the side panels of the outer frame of the appliance.

The lid or hood (3) from the rear as it is mounted on the frame of the case leaving a certain distance in between. L-shaped angle iron (4) touches the corners and is welded at the corners having been given a U shape. FIG. 5 illustrates the angle iron as welded after sufficient space has been provided from the inside and from the outside. FIG. 6 illustrates the U shaped steel bars (9) welded into the screw receiving hole. The screw receiving hole is welded on the steel casing in such a manner to enable the screwing of the hood from the outside and from the top.

The flame entry point has been calculated as not to cause any danger of poisoning. Therefore, the use of any other aerating system in the appliance is not required. The smoke exit means have been designed to facilitate an effective flow of the smoke through the chimney since the flame disseminate from the bottom and the mid-level at the rear of the appliance. This results in a very low level of an hazardous effect, of about 20%, on the environment and the economy. To achieve the best results and an efficient working of the system it is necessary that the appliance is heated for one hour and 30 minutes. The environment and the economy also benefits from operating the system in the most effective mode. Since no mortar or binding agent is used between the bricks, the transporting of the appliance to a new location is rather easy as the appliance can be dismantled and re-assembled quite easily.

What is claimed is:

1. A heating appliance comprising:

(A) an outer case made of chrome steel and including:

(i) a body frame (1) having a top, bottom, front, back and two opposed sides;

(ii) leg means (2) for supporting said frame;

(iii) lid or hood means (3) for covering said frame top;

(iv) mounting means (4) for mounting said lid or hood means over said frame top; and (v) smoke outlet pipe means (5) extending through said outer case for discharging smoke;

(B) various brick systems (15) arranged as stacks of rows in said frame at both said frame front and said frame back, including:

(i) front bridge-shaped bricks (16) and rear bridge-shaped bricks (17) disposed on said frame bottom;

(ii) at least one rectangular-shaped base brick (18) disposed between said front and rear bricks for bridging the same; and (iii) right-to-left or side-to-side bricks (22 S-S) forming layers intermediate said front bricks and intermediate rear bricks; and (C) additional brick systems including:

(i) vent-defining bricks (19) defining an outlet and discharge vent for receiving said smoke outlet pipe means;

(ii) lining bricks (20) for lining an interior surface of said two opposed frame sides, and lining bricks (21) for lining an interior surface of said lid or hood means; and (iii) lining half-bricks (23) to supply additional height and protection to said case at the level of said lid or hood means.

2. A heating appliance according to claim 1, additionally comprising steam pipes formed of chrome (13, 14) and mounted between said intermediate layers to ensure that heat spreads rapidly throughout the appliance.

3. A heating appliance according to either of claims 1 and 2, additionally comprising at least one valve installed on said smoke outlet pipe means to maintain heat within said case for a long period of time once said brick systems, said bricks and said smoke outlet pipe means are sufficiently heated.

4. A heating appliance according to claim 1, wherein said various brick systems includes stacks of rows of bridge-shaped bricks disposed on said frame bottom intermediate said front and rear bricks.

* * * * *